US007775270B1

(12) United States Patent
Sipos

(10) Patent No.: US 7,775,270 B1
(45) **Date of Patent: *Aug. 17, 2010**

(54) SPIDER WITH DISTRIBUTED GRIPPING DIES

(76) Inventor: David L. Sipos, 206 Greenhaven Dr., Lafayette, LA (US) 70508

( * ) Notice: Subject to any disclaimer, the term of this patent is extended or adjusted under 35 U.S.C. 154(b) by 259 days.

This patent is subject to a terminal disclaimer.

(21) Appl. No.: 10/959,278

(22) Filed: Oct. 5, 2004

(51) Int. Cl.
*E21B 19/10* (2006.01)

(52) U.S. Cl. ..... 166/77.52; 166/77.53; 175/423

(58) Field of Classification Search ..... 166/77.51, 166/77.52, 77.53; 175/423
See application file for complete search history.

(56) References Cited

U.S. PATENT DOCUMENTS

| | | | | |
|---|---|---|---|---|
| 1,718,998 | A * | 7/1929 | Carroll | 175/423 |
| 1,719,533 | A * | 7/1929 | Cady | 175/423 |
| 2,071,637 | A * | 2/1937 | Laurent | 188/67 |
| 2,127,108 | A | 8/1938 | Driscoll | |
| 3,331,585 | A * | 7/1967 | Dubberke | 254/31 |
| 4,332,062 | A | 6/1982 | Byrne, Jr. | |
| 5,451,084 | A * | 9/1995 | Jansch | 294/1.1 |
| 6,367,557 | B1 * | 4/2002 | Rosine et al. | 166/384 |
| 6,394,201 | B1 * | 5/2002 | Feigel et al. | 175/423 |
| 6,471,439 | B2 * | 10/2002 | Allamon et al. | 403/374.1 |
| 6,557,641 | B2 | 5/2003 | Sipos et al. | |
| 6,892,810 | B2 * | 5/2005 | Austbo et al. | 166/85.5 |
| 7,267,168 | B1 * | 9/2007 | Sipos | 166/77.52 |
| 2003/0173117 | A1 * | 9/2003 | Mason et al. | 175/423 |
| 2004/0163853 | A1 * | 8/2004 | Baugh | 175/423 |

OTHER PUBLICATIONS

U.S. Appl. No. 10/949,151 to David L. Sipos for Spider with Discrete Die Supports. filed Sep. 24, 2004.
U.S. Appl. No. 11/070,175 to David L. Sipos for Discrete Element Spider. filed Mar. 1, 2005.

* cited by examiner

*Primary Examiner*—David J Bagnell
*Assistant Examiner*—David Andrews

(57) ABSTRACT

The spider has a body with a slip bowl of extended vertical length to enable gripping diameters having a gripping range of at least twenty percent greater than the minimum diameter to be gripped. A plurality of slips are distributed about the slip bowl surface, each slip carrying a plurality of dies vertically distributed on and affixed on the slip. Each die has a vee shaped surface, each face of the vee shaped surface provided with the equivalent of teeth to engage the outer surface of pipe to be gripped. The vee shaped dies, collectively, provide pipe contact lines about equally spaced about the outer periphery of gripped pipe.

21 Claims, 2 Drawing Sheets

SPIDER WITH DISTRIBUTED GRIPPING DIES

This invention pertains to a pipe string supporting drilling rig spider. More specifically it pertains to a spider that can safely grip a range of pipe diameters for safe support of vertical pipe string loads. The spider also spreads the radial gripping forces about the periphery of the gripped pipe in a preselected manner regardless of pipe diameter. As used herein, the terms "spider" and "elevator" are used interchangeably, and include related slip handling gear.

BACKGROUND OF THE INVENTION

Pipe strings being assembled in earth bore holes are supported at or near the upper end by spiders that rest on the derrick floor, or by elevators that are suspended from the rig traveling block. The pipe is added to the string, usually in lengths up to three sections if going into the hole, and usually by single sections while drilling. Removal of the pipe string from the hole proceeds in reversed steps, usually in lengths of two or three sections. A section is an uninterrupted length of about thirty feet, and is often called a joint.

Pipe string loads are most safely supported by engaging plane or tapered surfaces on the pipe string. Such surfaces, however, are not always in a suitable position relative to the spiders or elevators and the pipe string has to be supported by gripping the outer cylindrical surface of the pipe.

A pipe load support assembly, known as the "fail safe system" comprises a spider with a generally central opening to accept vertically situated pipe. The opening is defined by a slip bowl surface that is conical, opening upwardly. A plurality of slips is distributed peripherally about the slip bowl surface. Slip handling gear moves the slips vertically along the slip bowl surface. The vertical movement forces a proportionately less radial movement. The slips, each, have gripping surfaces situated to contact the outer surface of the pipe in the opening. The gripping surfaces are usually on dies that attach to the slips. A plurality of dies, usually three or more, are vertically distributed on each slip.

The slips are effectively wedges that are supported in conical bores of slip bowls in the spider body. The vertical force on the slips results in a proportionally greater radial force thrusting each slip toward the pipe to be gripped. The surface of the pipe is gripped by teeth, or the equivalent, supported on the slip. The teeth wear and occasionally have to be replaced. To enable tooth replacement on the slips, the slips usually have surfaces to accept, capture, and support dies with teeth adapted to the requirement of the pipe load and surface to be gripped.

Spiders often have "fall back" openings near the conical surfaces of the slip bowl to allow slips to move radially outward after a small amount of lifting to release the grip on pipe. That fall back allows enlargements on the pipe string to pass through the spider opening. Such enlargements may include couplings. The "fall back" arrangement increases the size of enlargements that can pass through the spider but does not increase the range of diameters that the spider can safely grip without changes in spider configuration.

On modern pipe strings there are many enlargements, other than couplings, that occur in such positions that they need to be gripped by the spider to enable the rig pipe tongs to function. Otherwise stated, pipe strings now consist of more than just pipe couplings. There is now a need to use the spider for an extended gripping range in terms of diameter.

Gripping range, in terms of diameter, is influenced by the manner of gripping such that pipe surfaces will not be damaged when very large pipe string loads must be supported. To maximize the load supporting ability of pipe being gripped, the points of application of radial load needs to be equally distributed about the periphery of the pipe being gripped. Ideally, the optimal distribution of radial loads should not change due to changes in pipe diameter.

Pipe strings supported by gripping dies often receive substantial torque transmitted from the spider to the pipe. Often, the torque is collateral with other rig floor activities. Gripping dies that have teeth on a cylindrical surface that approximates the pipe outer cylindrical surface, when torque is being transmitted to the pipe, tilt somewhat as a result of machine slack and strain. When the dies tilt, one edge tends to gouge into the pipe. The resulting load concentration tends to distort the pipe with unplanned consequent pipe surface damage. Vee shaped dies do not contact pipe with an edge and load concentrations are distributed over more die surface. The resulting two vertical lines of die and pipe surface contact has a stabilizing effect. There is still some tilt from slack and strain but with less unexpected tendency to distort or damage pipe being gripped.

SUMMARY OF INVENTION

The spider has a vertically extended length of slip bowl surface and extended reach of slip manipulation gear in order to grip an extended range of pipe diameters. The pipe gripping dies have vee shaped pipe surface engaging toothed surfaces arranged to grip pipe along two peripherally separated vertical lines. The separation of vertical lines related to a single die is approximately equal to the separation of the nearest vertical line related to each adjacent die. Otherwise stated, the plurality of vertical lines related to a plurality of dies is about equally spaced about the periphery of a gripped pipe surface.

It is commonplace for spiders and elevators to be used interchangeably, and both have slip manipulation gear to control the vertical position of the slips relative to the slip bowl, well known to those skilled in the well related art. For use herein, the term "spider" will be construed to mean either spiders or elevators, either equipped with slip manipulation gear.

These and other objects, advantages, and features of this invention will be apparent to those skilled in the art from a consideration of this specification, including the attached claims and appended drawings

DETAILED DESCRIPTION OF DRAWINGS

In the formal drawings, features that are well established in the art and do not bear upon points of novelty are omitted in the interest of descriptive clarity. Such omitted features may include threaded junctures, weld lines, sealing elements, pins and brazed junctures.

Figure 1:
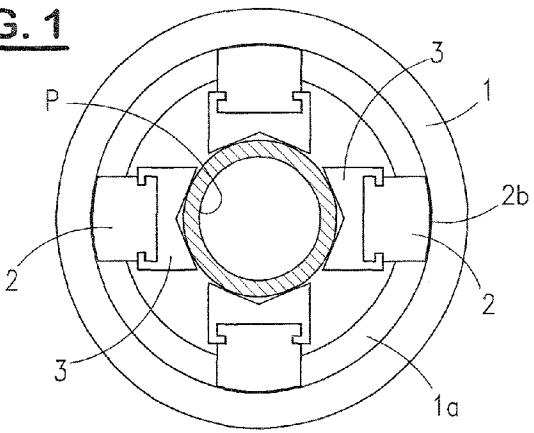
FIG. 1 is a top view of a spider with a gripped pipe in place but without slip manipulation gear.

FIG. 1 shows body 1, with slip bowl surface 1*a* carrying slips 2 fitted with die plurality 3 gripping pipe P. Slip surface 2*b* engages the conical slip bowl surface 1*a*.

Figure 2:
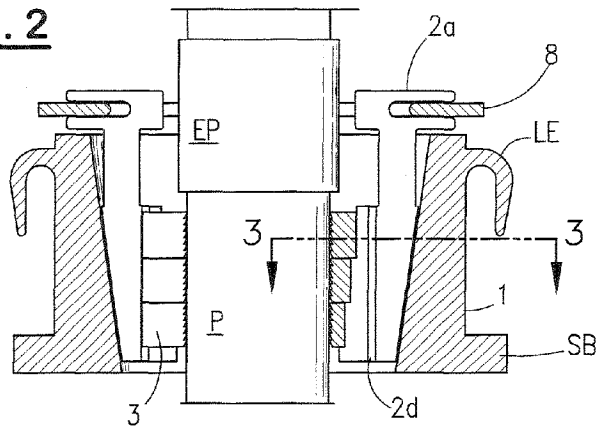
FIG. 2 is a side view of the spider of FIG. 1 with only the spider body, a synchronizing ring, and one set of dies sectioned by a plane that contains the pipe center line.

FIG. 2 shows body 1, with spider base SB and lifting ears LE and slip bowl surface 1*a* carrying slips 2 fitted with die plurality 3 gripping pipe P. Pipe P has enlarged portion EP. Slips 2 have vertical slide ways 2*d* (one on each side) to accept the dies 3. Slip handling gear is shown with synchronizing ring 8 to act on the slips for vertical control. Slip handling gear is not part of the points of novelty being claimed. Slip handling gear is well known to those skilled in the art and details are not shown. The slip bowl has an extended vertical length to accept diameter changes in the pipe assembly. The slip handling gear available can accept, or be adapted to accept, the needed vertical movement range. Such adaptation, if needed, is well within the ability of those skilled in the art.

Figure 3:
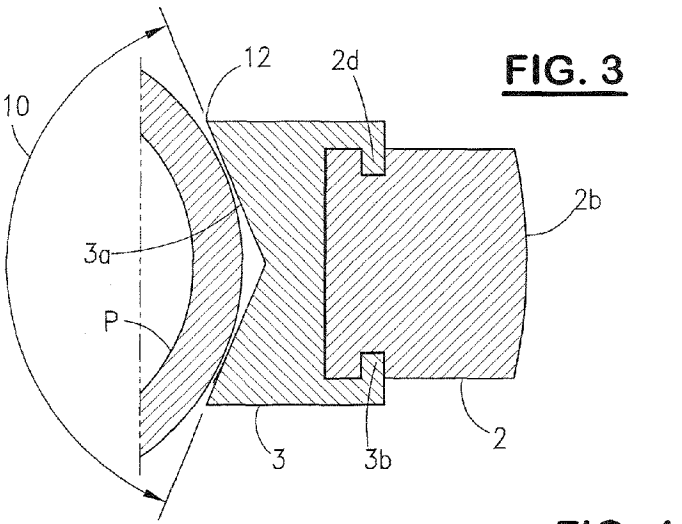
FIG. 3 is a fragmented section, taken along line 3-3, showing a slip, die, and pipe portion.

FIG. 3 is an enlarged fragmentary sectional view taken along line 3-3 and shows slip 2 with slide ways 2*d* carrying die 3 with slide way engaging projection 3*b* securing the die on the slip. Surface 2*b* engages the slip bowl surface 1*a* (not shown) to induce radial movement against the pipe P when slips are moved downwardly relative to the body 1. Die surface 3*a* has teeth, or the equivalent, to grip pipe. Lifting ears LE are common on spiders and permit the spider to function as an elevator. That is a well known feature to those skilled in the art. Spider base SB allows the spider to rest on the derrick floor, or the equivalent.

Figure 4:
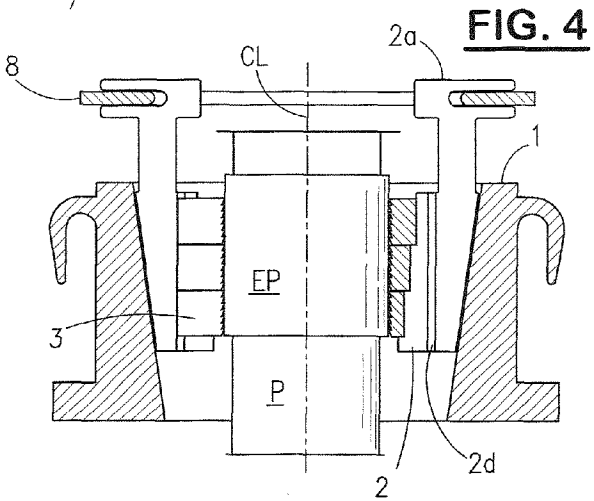
FIG. 4 is a partly sectioned side view similar to FIG. 2 showing the gripping of a pipe enlargement.

FIG. 4 is identical to FIG. 2, with the slips lifted to permit the dies to engage pipe enlargement EP.

Figure 7:
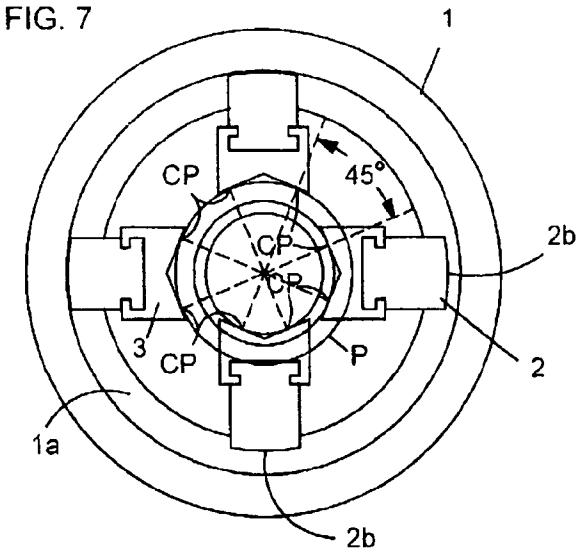
FIG. 7 is similar to FIG. 5 but shows details of vee shaped die surface and pipe contact lines and their effect upon different gripped pipe surface diameters.
Figure 5:
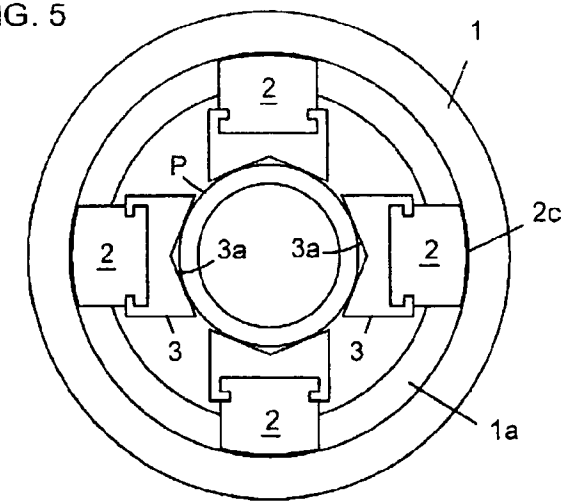
FIG. 5 is similar to FIG. 1, showing the arrangement of vee shaped die gripping surfaces.

FIG. 5 is generally identical to FIG. 1 but is set up to describe the function of vee shaped surface 3*a* on dies 3, (note FIG. 7).

Figure 6:
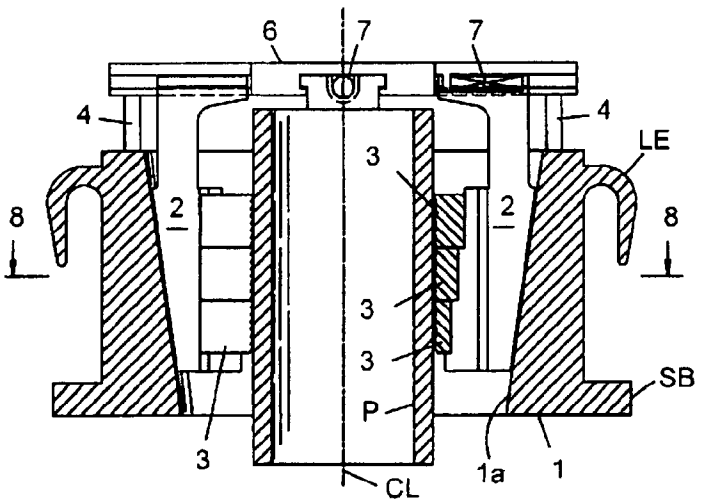
FIG. 6 is similar to FIG. 2 but shows the preferred slip manipulation gear and die surface distributions.

FIG. 6 is similar to FIG. 2 but shows slip manipulation plate 6, vertically controlled by rams 4 to vertically position slips 2. Springs 7 urge the slips radially outward to keep the slips in contact with slip bowl surface 1*a*. Plate 6 synchronizes the movement of the slips.

FIG. 7 shows four slips with vee shaped dies situated to engage the pipe at lines CP (just points on the section) and this arrangement provides contact lines separated by 45 degrees around the pipe periphery. Larger spiders may have many slips, often as many as twelve. Twelve slips would result in twenty-four lines CP distributed about the pipe periphery. The lines CP would then be spread fifteen degrees apart.

In the case of eight contact lines separated by 45 degrees, the angle 10 of the pipe gripping surfaces of the vee shaped dies will be 135 degrees. In the case of twenty-four contact lines separated by fifteen degrees, the angle 10 of the pipe gripping surfaces of the vee shaped dies will be 165 degrees.

Figure 8:
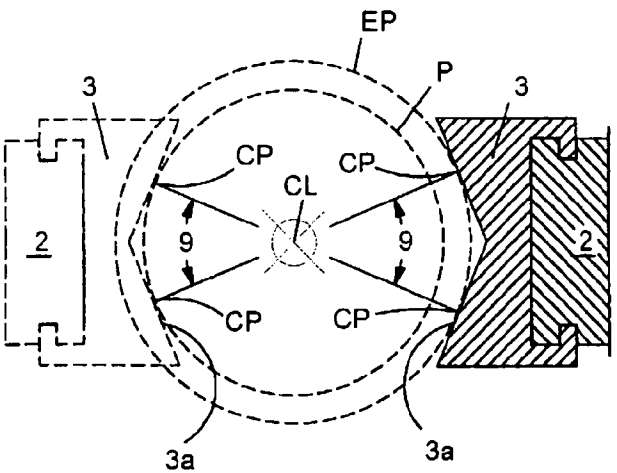
FIG. 8 is a fragmented section taken along line 8-8, enlarged, showing the angular distribution of contact lines for just two opposed dies.

FIG. 8 is an enlarged graphic description of pipe surface contact lines produced by the vee shaped dies 3 at die surfaces 3*a*. The dashed outline on the left side shows the contact lines to have the same arcuate spread of contact lines CP on a different pipe diameter. The right hand die grips pipe enlargement EP and the left hand die (shown here for description of an alternate diameter) grips the surface of smaller diameter of pipe P. The arcuate spread of lines CP remains the same, 9, on both diameters. This configuration, if fully shown would result in a CP spread of eight lines CP equally distributed about the periphery of any pipe gripped, within the diameter range of the configuration shown.

The illustration should not be construed as a limiting factor. The equal distribution of the lines CP need only be approximate to achieve the desired effect of near optimization of the spread of distortion producing radial forces on the gripped pipe. That is anticipated by and is within the scope of the claims.

As show in FIG. 3, the pipe gripping surfaces (shown in this embodiment as die surface 3*a*) have sufficient width so that an outermost vertical edge 12 of the pipe gripping surfaces does not contact the pipe P.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

I claim:

1. A pipe load support assembly for use on well bore drilling and servicing rigs, said rig having a generally centrally located opening for accepting vertically situated pipe comprising:

(a) a plurality of slips supported and distributed peripherally about said centrally located opening of said rig, said slips having surfaces to relate vertical and radial movement of said slips;

(b) a plurality of pipe gripping dies distributed on each slip; and (c) pipe gripping surfaces on each of said dies, wherein said plurality of slips are configured so that said pipe gripping surfaces of said plurality of pipe gripping dies collectively engage the outer surfaces of said vertically situated pipe along vertical lines about equally separated peripherally around said outer surface of said vertically situated pipe, said pipe gripping surfaces having sufficient width so that an outermost vertical edge of said pipe gripping surfaces does not contact the pipe and wherein said pipe gripping surfaces on each of said dies are vee shaped.

2. The pipe load support assembly recited in claim 1, wherein an angle of said pipe gripping surfaces is selected from the group consisting of 135 degrees, 150 degrees, 157.5 degrees, 162 degrees and 165 degrees.

3. The pipe load support assembly recited in claim 1, wherein an angle of said pipe gripping surfaces is at least 135 degrees but not more than 165 degrees.

4. The pipe load support assembly recited in claim 3 further comprising teeth on said pipe gripping surfaces.

5. The pipe load support assembly recited in claim 1 further comprising teeth on said pipe gripping surfaces.

6. A pipe load support assembly for use on well bore drilling and servicing rigs comprising:

(a) a body for accepting vertically situated pipe;

(b) a plurality of slips distributed peripherally about said body around said vertically situated pipe, said slips having surfaces to cooperate with said body to relate vertical and radial movement of said slips;

(c) at least one pipe gripping die mounted on each slip; and (d) pipe gripping surfaces on each said die, wherein said plurality of slips are configured so that said pipe gripping surfaces of said pipe gripping dies collectively engage the outer surface of said vertically situated pipe along vertical lines about equally separated peripherally around said outer surface of said pipe, said pipe gripping surfaces having sufficient width so that an outermost vertical edge of said pipe gripping surfaces does not contact the pip;

and wherein said pipe gripping surfaces on each said die are vee shaped.

7. The pipe load support assembly recited in claim 6, wherein said pipe support assembly is a spider.

8. The pipe load support assembly recited in claim 6, wherein said pipe support assembly is an elevator.

9. The pipe load support assembly recited in claim 6, wherein an angle of said pipe gripping surfaces selected from the group consisting of 135 degrees, 150 degrees, 157.5 degrees, 162 degrees and 165 degrees.

10. The pipe load support assembly recited in claim 6, wherein an angle of said pipe gripping surfaces is at least 135 degrees but not more than 165 degrees.

11. The pipe load support assembly recited in claim 10 further comprising teeth on said pipe gripping surfaces.

12. The pipe load support assembly recited in claim 6 further comprising teeth on said pipe gripping surfaces.

13. A spider, as defined herein, for use on well bore drilling and servicing rigs, the spider comprising:

a) a body with a generally central opening defined by a generally conical slip bowl surface opening upwardly and having a vertical axis;

b) a plurality of slips distributed peripherally about said conical surface, with surfaces to cooperate with the slip bowl surface to relate vertical and radial movement of the slips;

c) a plurality of pipe gripping dies, vertically distributed on each slip and arranged to engage the outer surface of gripped pipe situated vertically in the opening;

d) vee shaped pipe gripping surfaces on said dies, opening toward said center line, situated to engage the outer surface of gripped pipe, extending along said center line, along two vertical lines peripherally separated a preselected amount; and e) wherein an angle of said vee shaped pipe gripping surfaces is selected from the group consisting of 135 degrees, 150 degrees, 157.5 degrees, 162 degrees and 165 degrees.

14. A spider, as defined herein, for use on well bore drilling and servicing rigs, the spider comprising:

a) a body with a generally central opening defined by a generally conical slip bowl surface opening upwardly and having a vertical axis;

b) a plurality of slips distributed peripherally about said conical surface, with surfaces to cooperate with the slip bowl surface to relate vertical and radial movement of the slips;

c) a plurality of pipe gripping dies, vertically distributed on each slip and arranged to engage the outer surface of gripped pipe situated vertically in the opening;

d) vee shaped pipe gripping surfaces on said dies, opening toward said center line, situated to engage the outer surface of gripped pipe, extending along said center line, along two vertical lines peripherally separated a preselected amount; and e) wherein said an angle of said pipe gripping surfaces is at least 135 degrees but not more than 165 degrees.

15. The spider recited in claim 14 further comprising teeth on said pipe gripping surfaces.

16. An elevator, as defined herein, for use on well bore drilling and servicing rigs, the elevator compromising:

a) a body with a generally central opening defined by a generally conical slip bowl surface opening upwardly and having a vertical axis;

b) a plurality of slips distributed peripherally about said conical surface, with surfaces to cooperate with the slip bowl surface to relate vertical and radial movement of the slips;

c) a plurality of pipe gripping dies, vertically distributed on each slip and arranged to engage the outer surface of gripping pipe situated vertically in the opening;

d) vee shaped pipe gripping surface on said dies, opening toward said center line, situated to engage the outer surface of gripped pipe, extending along said center line, along two vertical lines peripherally separated a preselected amount; and e) wherein an angle of said vee shaped pipe gripping surfaces is selected from the group consisting of 135 degrees, 150 degrees, 157.5 degrees, 162 degrees and 165 degrees.

17. An elevator, as defined herein, for use on well bore drilling and servicing rigs, the elevator compromising:

a) a body with a generally central opening defined by a generally conical slip bowl surface opening upwardly and having a vertical axis;

b) a plurality of slips distributed peripherally about said conical surface, with surfaces to cooperate with the slip bowl surface to relate vertical and radial movement of the slips;

c) a plurality of pipe gripping dies, vertically distributed on each slip and arranged to engage the outer surface of gripping pipe situated vertically in the opening;

d) vee shaped pipe gripping surface on said dies, opening toward said center line, situated to engage the outer surface of gripped pipe, extending along said center line, along two vertical lines peripherally separated a preselected amount; and e) wherein said an angle of said pipe gripping surfaces is at least 135 degrees but not more than 165 degrees.

18. The elevator recited in claim 17 further comprising teeth on said pipe gripping surfaces.

19. A pipe load support assembly for use on well bore drilling and servicing rigs, said rig having a generally centrally located opening for accepting vertically situated pipe comprising:

(a) a plurality of slips supported and distributed peripherally about said centrally located opening of said rig, said slips having surfaces to relate vertical and radial movement of said slips;

(b) at least one pipe gripping die on each said slip; and pipe gripping surfaces on each of said dies, wherein said plurality of slips are configured so that said pipe gripping surfaces of said pipe gripping dies collectively engage the outer surfaces of said vertically situated pipe along at least eight but not more than 24 vertical lines about equally separated peripherally around said outer surface of said vertically situated pipe, said pipe gripping surfaces having sufficient width so that an edge of said dies outermost vertical edge of said pipe gripping surfaces does not contact the pipe; and wherein said pipe gripping surfaces on each of said dies are vee shaped.

20. The pipe load support assembly recited in claim 19, wherein an angle of said pipe gripping surfaces is at least 135 degrees but not more than 165 degrees.

21. The pipe load support assembly recited in claim 20 further comprising teeth on said pipe gripping surfaces.

* * * * *